US009387568B1

(12) United States Patent
Ilaw et al.

(10) Patent No.: US 9,387,568 B1
(45) Date of Patent: Jul. 12, 2016

(54) SYSTEMS AND METHODS FOR CORRECTING FABRICATION ERROR IN MAGNETIC RECORDING HEADS USING MAGNETIC WRITE WIDTH MEASUREMENTS

(71) Applicant: Western Digital Technologies, Inc., Irvine, CA (US)

(72) Inventors: Reymon G. Ilaw, Bangpa-In (TH); Augustus C. Calub, Bangpa-In (TH); Theera Yaemglin, Lumlukka (TH); Manit Kiatkhumjaikajorn, Thonburi (TH); Ittipon Cheowanish, Bangsrimuang (TH)

(73) Assignee: Western Digital Technologies, Inc., Irvine, CA (US)

( * ) Notice: Subject to any disclaimer, the term of this patent is extended or adjusted under 35 U.S.C. 154(b) by 609 days.

(21) Appl. No.: 13/779,693

(22) Filed: Feb. 27, 2013

(51) Int. Cl.

| | |
|---|---|
| ***G05B 11/01*** | (2006.01) |
| ***B24B 37/04*** | (2012.01) |
| *B24B 37/30* | (2012.01) |
| *B24B 37/013* | (2012.01) |

(52) U.S. Cl.
CPC ..... *B24B 37/048* (2013.01); *B24B 37/013* (2013.01); *B24B 37/30* (2013.01)

(58) Field of Classification Search
CPC .. G11B 5/3169; G11B 5/3166; G11B 5/3116; G11B 5/1871; G11B 5/3103; G11B 5/455; Y10T 29/49021; Y10T 29/49032; B24B 37/013; B24B 37/00; B24B 49/04; B24B 37/005
See application file for complete search history.

(56) References Cited

U.S. PATENT DOCUMENTS

| | | | | |
|---|---|---|---|---|
| 4,511,942 | A | 4/1985 | Valstyn | |
| 5,210,667 | A | 5/1993 | Zammit | |
| 5,214,589 | A | 5/1993 | Tang | |
| 5,361,547 | A * | 11/1994 | Church et al. | 451/5 |
| 5,386,666 | A | 2/1995 | Cole | |
| 5,463,805 | A | 11/1995 | Mowry et al. | |
| 5,516,323 | A | 5/1996 | Carlson et al. | |
| 5,559,429 | A | 9/1996 | Mowry et al. | |
| 5,597,340 | A * | 1/1997 | Church et al. | 451/5 |
| 5,722,155 | A | 3/1998 | Stover et al. | |
| 5,755,612 | A | 5/1998 | Schaenzer et al. | |

(Continued)

OTHER PUBLICATIONS

Lau et al., Using a neura-fuzzy approach for improving the perpendicular magnetic recording head manufacturing process, Int. J. Intelligent Information and Database Systems, vol. 4, Issue 5, 2010.*

(Continued)

*Primary Examiner* — Darrin Dunn

(57) ABSTRACT

Systems and methods for correcting fabrication error in magnetic recording heads using magnetic write width (MWW) measurements are provided. One such method includes separating a wafer into sections containing row bars, each row bar including magnetic recording heads, selecting a first row bar from a first section of the sections, lapping the first row bar to form sliders, performing a test of a magnetic write width (MWW) on each of the sliders, calculating a first error profile for the first row bar based on results of the magnetic write width tests, generating a second error profile for a stripe height of a component of the sliders based on the first error profile, where the component is selected from a magnetic read head and a magnetic write head, and lapping a second row bar from the row bars of the first section using the second error profile.

17 Claims, 5 Drawing Sheets

(56) References Cited

U.S. PATENT DOCUMENTS 5,816,890 A 10/1998 Hao et al.
5,876,264 A 3/1999 Church et al.
6,027,397 A 2/2000 Church et al.
6,034,849 A 3/2000 Takizawa
6,047,224 A 4/2000 Stover et al.
6,075,673 A 6/2000 Wilde et al.
6,093,083 A * 7/2000 Lackey ..... 451/28
6,097,575 A 8/2000 Trang et al.
6,125,014 A 9/2000 Riedlin, Jr.
6,125,015 A 9/2000 Carlson et al.
6,130,863 A 10/2000 Wang et al.
6,137,656 A 10/2000 Levi et al.
6,144,528 A 11/2000 Anaya-Dufresne et al.
6,147,838 A 11/2000 Chang et al.
6,151,196 A 11/2000 Carlson et al.
6,178,064 B1 1/2001 Chang et al.
6,181,522 B1 1/2001 Carlson
6,181,673 B1 1/2001 Wilde et al.
6,193,584 B1 * 2/2001 Rudy et al. ..... 451/5
6,229,672 B1 5/2001 Lee et al.
6,230,389 B1 * 5/2001 Zhu ..... 29/603.1
6,236,543 B1 5/2001 Han et al.
6,246,547 B1 6/2001 Bozorgi et al.
6,249,404 B1 6/2001 Doundakov et al.
6,261,165 B1 * 7/2001 Lackey et al. ..... 451/387
6,330,131 B1 12/2001 Nepela et al.
6,330,488 B1 12/2001 Yoshida et al.
6,339,518 B1 1/2002 Chang et al.
6,347,983 B1 * 2/2002 Hao et al. ..... 451/57
6,349,017 B1 2/2002 Schott
6,373,660 B1 4/2002 Lam et al.
6,378,195 B1 4/2002 Carlson
6,483,658 B1 * 11/2002 Nguyen ..... 360/77.01
6,522,504 B1 2/2003 Casey
6,538,850 B1 3/2003 Hadian et al.
6,583,953 B1 6/2003 Han et al.
6,646,832 B2 11/2003 Anaya-Dufresne et al.
6,661,612 B1 12/2003 Peng
6,665,146 B2 12/2003 Hawwa et al.
6,679,760 B2 1/2004 Fukuroi et al.
6,684,171 B2 * 1/2004 Church et al. ..... 702/104
6,690,545 B1 2/2004 Chang et al.
6,704,173 B1 3/2004 Lam et al.
6,708,389 B1 3/2004 Carlson et al.
6,717,773 B2 4/2004 Hawwa et al.
6,721,142 B1 4/2004 Meyer et al.
6,744,599 B1 6/2004 Peng et al.
6,758,722 B2 * 7/2004 Zhu ..... 451/5
6,771,468 B1 8/2004 Levi et al.
6,786,803 B2 * 9/2004 Crawforth et al. ..... 451/41
6,796,018 B1 9/2004 Thornton
6,801,402 B1 10/2004 Subrahmanyam et al.
6,843,705 B2 * 1/2005 Boutaghou ..... 451/5
6,856,489 B2 2/2005 Hawwa et al.
6,873,496 B1 3/2005 Sun et al.
6,884,148 B1 * 4/2005 Dovek et al. ..... 451/5
6,912,103 B1 6/2005 Peng et al.
6,937,439 B1 8/2005 Chang et al.
6,944,938 B1 * 9/2005 Crue et al. ..... 29/603.12
6,950,289 B2 9/2005 Lam et al.
6,956,718 B1 10/2005 Kulkarni et al.
6,972,930 B1 12/2005 Tang et al.
6,992,849 B2 * 1/2006 Yeo et al. ..... 360/75
7,006,330 B1 2/2006 Subrahmanyam et al.
7,006,331 B1 2/2006 Subrahmanyam et al.
7,010,847 B1 3/2006 Hadian et al.
7,019,945 B1 3/2006 Peng et al.
7,027,264 B1 4/2006 Subrahmanyam et al.
7,061,725 B2 * 6/2006 Seigler ..... 360/313
7,085,104 B1 8/2006 Hadian et al.
7,099,117 B1 8/2006 Subrahmanyam et al.
7,108,578 B2 * 9/2006 Lin et al. ..... 451/5
7,147,539 B1 * 12/2006 Hao et al. ..... 451/5
7,174,622 B2 2/2007 Meyer et al.
7,289,299 B1 10/2007 Sun et al.
7,307,816 B1 12/2007 Thornton et al.
7,315,435 B1 1/2008 Pan
7,315,436 B1 1/2008 Sanchez
7,359,152 B2 4/2008 Matono et al.
7,414,814 B1 8/2008 Pan
7,436,631 B1 10/2008 Fanslau, Jr. et al.
7,469,468 B1 * 12/2008 Cross et al. ..... 29/603.16
7,474,508 B1 1/2009 Li et al.
7,477,486 B1 1/2009 Sun et al.
7,525,307 B2 * 4/2009 Shen ..... 324/210
7,587,809 B2 * 9/2009 Dimitrov et al. ..... 29/603.12
7,593,190 B1 9/2009 Thornton et al.
7,595,963 B1 9/2009 Chen et al.
7,616,405 B2 11/2009 Hu et al.
7,681,303 B2 3/2010 Kondo et al.
7,703,193 B2 * 4/2010 Beaucage et al. ..... 29/603.09
7,729,089 B1 6/2010 Hogan
7,911,736 B2 * 3/2011 Bajorek ..... 360/122
7,914,362 B2 * 3/2011 Bunch et al. ..... 451/5
7,995,310 B1 8/2011 Pan
8,003,304 B2 8/2011 Nikitin et al.
8,027,129 B2 * 9/2011 Nowak et al. ..... 360/324
8,047,894 B2 * 11/2011 Bunch et al. ..... 451/5
8,065,788 B2 * 11/2011 Guruz et al. ..... 29/603.16
8,081,400 B1 12/2011 Hu
8,087,973 B1 1/2012 Sladek et al.
8,089,730 B1 1/2012 Pan et al.
8,151,441 B1 * 4/2012 Rudy et al. ..... 29/603.09
8,164,858 B1 4/2012 Moravec et al.
8,165,709 B1 * 4/2012 Rudy ..... 700/121
8,199,437 B1 6/2012 Sun et al.
8,208,224 B1 6/2012 Teo et al.
8,218,268 B1 7/2012 Pan
8,240,545 B1 8/2012 Wang et al.
8,256,272 B1 9/2012 Roajanasiri et al.
8,291,743 B1 10/2012 Shi et al.
8,295,012 B1 10/2012 Tian et al.
8,295,013 B1 10/2012 Pan et al.
8,295,014 B1 10/2012 Teo et al.
8,307,539 B1 * 11/2012 Rudy et al. ..... 29/603.09
8,320,084 B1 11/2012 Shum et al.
8,325,446 B1 12/2012 Liu et al.
8,325,447 B1 12/2012 Pan
8,339,742 B1 12/2012 Sladek et al.
8,339,747 B1 12/2012 Hales et al.
8,339,748 B2 12/2012 Shum et al.
8,343,363 B1 1/2013 Pakpum et al.
8,345,519 B1 1/2013 Pan
8,390,962 B2 * 3/2013 Gunder et al. ..... 360/316
8,418,353 B1 4/2013 Moravec et al.
8,441,896 B2 5/2013 Wang et al.
8,443,510 B1 5/2013 Shi et al.
8,446,694 B1 5/2013 Tian et al.
8,456,643 B2 6/2013 Prabhakaran et al.
8,456,776 B1 6/2013 Pan
8,462,462 B1 6/2013 Moravec et al.
8,477,459 B1 7/2013 Pan
8,485,579 B2 7/2013 Roajanasiri et al.
8,488,279 B1 7/2013 Pan et al.
8,488,281 B1 7/2013 Pan
8,490,211 B1 7/2013 Leary
8,514,522 B1 8/2013 Pan et al.
8,533,936 B1 9/2013 Puttichaem et al.
8,545,164 B2 10/2013 Choumwong et al.
8,553,365 B1 10/2013 Shapiro et al.
8,587,901 B1 11/2013 Puttichaem et al.
8,593,764 B1 11/2013 Tian et al.
8,599,653 B1 12/2013 Mallary et al.
8,605,389 B1 12/2013 Pan et al.
8,611,050 B1 12/2013 Moravec et al.
8,611,052 B1 12/2013 Pan et al.
8,623,197 B1 1/2014 Kobsiriphat et al.
8,624,184 B1 1/2014 Souza et al.
8,665,566 B1 3/2014 Pan et al.
8,665,567 B2 3/2014 Shum et al.
8,665,677 B1 3/2014 Panitchakan et al.
8,665,690 B1 3/2014 Moravec et al.
8,693,144 B1 4/2014 Pan et al.
8,717,709 B1 * 5/2014 Shi et al. ..... 360/125.13

(56) References Cited

U.S. PATENT DOCUMENTS

| | | | | |
|---|---|---|---|---|
| 8,756,795 | B1 | 6/2014 | Moravec et al. | |
| 8,758,083 | B1 | 6/2014 | Rudy et al. | |
| 8,760,812 | B1 | 6/2014 | Chen et al. | |
| 8,770,463 | B1 | 7/2014 | Puttichaem et al. | |
| 8,773,664 | B1 | 7/2014 | Wang et al. | |
| 8,792,212 | B1 | 7/2014 | Pan et al. | |
| 8,792,213 | B1 | 7/2014 | Vijay et al. | |
| 8,797,691 | B1 | 8/2014 | Tian et al. | |
| 2003/0197854 | A1* | 10/2003 | Fox et al. | 356/72 |
| 2003/0200041 | A1* | 10/2003 | Church et al. | 702/104 |
| 2003/0214764 | A1* | 11/2003 | Sapozhnikov et al. | 360/324.12 |
| 2004/0009739 | A1* | 1/2004 | Zhu | 451/41 |
| 2004/0180608 | A1* | 9/2004 | Church et al. | 451/29 |
| 2005/0070206 | A1* | 3/2005 | Kasiraj et al. | 451/5 |
| 2005/0122634 | A1* | 6/2005 | Childress et al. | 360/324.2 |
| 2005/0164607 | A1* | 7/2005 | Bajorek | 451/5 |
| 2006/0027528 | A1* | 2/2006 | Church et al. | 216/22 |
| 2006/0105677 | A1* | 5/2006 | Lin et al. | 451/5 |
| 2006/0168798 | A1* | 8/2006 | Naka | 29/603.16 |
| 2007/0070543 | A1* | 3/2007 | Gunder et al. | 360/126 |
| 2008/0042779 | A1* | 2/2008 | Carey et al. | 333/167 |
| 2008/0072418 | A1 | 3/2008 | Kondo et al. | |
| 2008/0157760 | A1* | 7/2008 | Shen | 324/210 |
| 2008/0160882 | A1* | 7/2008 | Gunder | 451/59 |
| 2009/0128954 | A1* | 5/2009 | Lau | 360/130.21 |
| 2009/0168216 | A1* | 7/2009 | Beach et al. | 360/31 |
| 2009/0197208 | A1 | 8/2009 | Nikitin et al. | |
| 2009/0323209 | A1* | 12/2009 | Kiyono | 360/31 |
| 2010/0061002 | A1* | 3/2010 | Nakagomi et al. | 360/31 |
| 2010/0085666 | A1* | 4/2010 | Zhou et al. | 360/324.12 |
| 2010/0142099 | A1* | 6/2010 | Hong et al. | 360/313 |
| 2010/0162556 | A1* | 7/2010 | Guruz et al. | 29/603.16 |
| 2010/0302662 | A1* | 12/2010 | Toba et al. | 360/31 |
| 2012/0018699 | A1* | 1/2012 | Chua et al. | 257/13 |
| 2012/0324720 | A1* | 12/2012 | Nakagomi et al. | 29/603.07 |
| 2013/0027032 | A1* | 1/2013 | Gao et al. | 324/252 |
| 2013/0244541 | A1 | 9/2013 | Yaemglin et al. | |
| 2013/0293982 | A1 | 11/2013 | Huber | |
| 2014/0154952 | A1* | 6/2014 | Druist et al. | 451/1 |
| 2014/0273764 | A1* | 9/2014 | Ronshaugen et al. | 451/57 |

OTHER PUBLICATIONS

Steven C. Rudy, et al., U.S. Appl. No. 12/880,913, filed Sep. 13, 2010, 24 pages.

* cited by examiner

SYSTEMS AND METHODS FOR CORRECTING FABRICATION ERROR IN MAGNETIC RECORDING HEADS USING MAGNETIC WRITE WIDTH MEASUREMENTS

FIELD

The present invention relates generally to manufacturing components for magnetic storage devices, and more specifically to systems and methods for correcting fabrication error in magnetic recording heads using magnetic write width (MWW) measurements.

BACKGROUND

Magnetic storage devices such as hard disk drives use magnetic media to store data and a movable slider having magnetic transducers (e.g., read/write heads) positioned over the magnetic media to selectively read data from and write data to the magnetic media. Electronic lapping guides (ELGs) are used for precisely controlling a degree of lapping applied to an air bearing surface (ABS) of the sliders for achieving a particular stripe height, or distance from the ABS, for the magnetic transducers located on the sliders. U.S. Pat. No. 8,165,709 to Rudy and U.S. Pat. No. 8,151,441 to Rudy et al., the entire content of each document is hereby incorporated by reference, provide a comprehensive description of ELGs used in manufacturing sliders for hard drives.

As the design of magnetic transducers becomes more and more intricate, their fabrication processes become increasingly complex as well. Such complex fabrication processes inherently include some imperfections that ultimately manifest as undesirable variations in the final product. By observing certain performance parameters of the final product (e.g., sliders including one or more magnetic transducers), these undesirable variations can be measured and quantified. A system and method for reducing or eliminating these undesirable variations in the performance of magnetic transducers is therefore needed.

SUMMARY

Aspects of the invention relate to systems and methods for correcting fabrication error in magnetic recording heads using magnetic write width (MWW) measurements. In one embodiment, the invention relates to a method of correcting for fabrication error in magnetic recording heads, the method including separating a wafer into a plurality of sections, each section containing a plurality of row bars, each row bar including a plurality of magnetic recording heads, selecting a first row bar from a plurality of row bars of a first section of the plurality of sections, lapping the first row bar to form a plurality of sliders, performing a test of a magnetic write width (MWW) on each of the plurality of sliders, calculating a first error profile for the first row bar based on results of the magnetic write width tests, generating a second error profile for a stripe height of a component of the plurality of sliders based on the first error profile, where the component is selected from the group consisting of a magnetic read head and a magnetic write head, and lapping a second row bar from the plurality of row bars of the first section using the second error profile.

DETAILED DESCRIPTION

Figure 1:
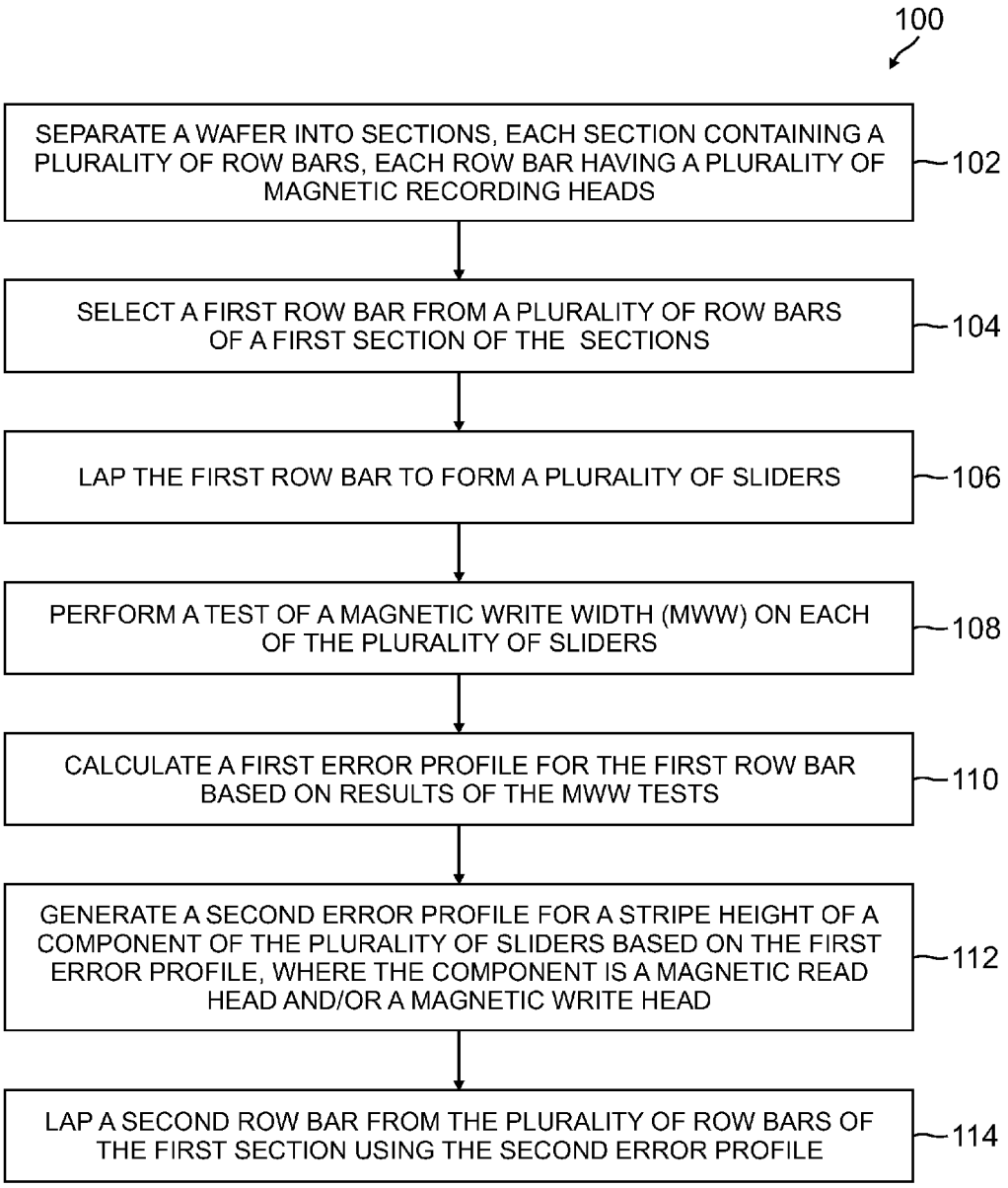
FIG. 1 is a flowchart of a process for correcting fabrication error in magnetic recording heads using magnetic write width (MWW) measurements in accordance with one embodiment of the invention.

As discussed above, a system and method for reducing or eliminating undesirable variations in the performance of magnetic transducers is needed. Such variations can be observed in the measured magnetic write width (MWW) of current magnetic heads. Current lapping algorithms are designed to achieve preselected reader or writer stripe heights (SHs) on a slider without consideration to MWW variations within a particular wafer.

The MWW measurements are measurements of variations in actual recording performance. Such variations may be caused by variations in the recording pole geometry, in the material properties, in yoke magnetic structures, and defects and misalignment associated with the write coil, lapping variations, etcetera. While multiple methods for performing MWW measurements are well known in the art, one exemplary method will be discussed. In the exemplary MWW test method, a test region of a magnetic medium is identified and pre-conditioned (e.g., by erasing the test region area). A data pattern is written to the test region at a given track center, where the data pattern can be a pseudo-random bit sequence that mimics actual recorded data or another suitable data pattern. In some cases, the data pattern is a single frequency square wave data pattern at about 50 percent of a maximum data rate for simplicity. The method then measures the readback amplitude dependence on the offset from the track center. The MWW is then calculated as the width of the track profile at 50 percent amplitude. In several embodiments, the MWW measurements are made using a spin-stand device. The MWW measurements are indicative of variations from intended write-field parameters, recording pole geometry, or other parameters, where the variations are often caused by the slider fabrication process.

Referring now to the drawings, embodiments of systems and methods for correcting fabrication error in magnetic recording heads using magnetic write width measurements are illustrated. In effect, the methods involve acquiring MWW test data for one or more sample sliders of a section of a wafer and then adjusting lapping stripe heights for the other sliders of the section to compensate for the measured MWW test data pattern across the section. As a result, the methods can reduce the measured MWW variation of the sliders and thereby provide significant yield improvement.

FIG. 1 is a flowchart of a process 100 for correcting fabrication error in magnetic recording heads using magnetic write width (MWW) measurements in accordance with one embodiment of the invention. The process first separates (102) a wafer into a number of sections, where each section contains a number of row bars and each row bar includes a preselected number of magnetic recording heads. The process then selects (104) a first row bar from a group of row bars in a first section of the wafer sections. The process then laps (106) the first row bar to form a preselected number of sliders. In several embodiments, the process laps the first row bar with an initial lapping profile. In some embodiments, the process selects two or more row bars and laps each of them to form the sliders.

The process then performs (108) a test of a magnetic write width (MWW) on each of the sliders. In several embodiments, the test of MWW is performed on a test machine (e.g., spin-stand) configured to test the performance characteristics of one or more sliders. The process then calculates (110) a first error profile for the first row bar based on results of the magnetic write width tests. In many embodiments, the first error profile includes calculation of an offset from a mean MWW value. In some embodiments, the mean value is for a particular group of sliders along the row bar (e.g., such as a first half and/or a second half of the sliders). In many embodiments, the first error profile includes an offset for each slider and a position of the respective slider along the row bar prior to the lapping.

The process then generates (112) a second error profile for a stripe height of a component of the sliders based on the first error profile, where the component is a magnetic read head and/or a magnetic write head. The second error profile can include a stripe height offset for each slider which can also be associated with a position of a respective slider. The process then laps (114) a second row bar from the row bars of the first section using the second error profile. In several embodiments, the process may lap all of the remaining row bars from the first section using the second error profile. In several embodiments, the process can be repeated for other sections on the wafer where each section has its own error profile based on the first row bar from the respective section that is processed to slider form and tested for MWW. In a number of embodiments, the process is repeated for each of the other sections on the wafer.

In one embodiment, the process can perform the sequence of actions in a different order. In another embodiment, the process can skip one or more of the actions. In other embodiments, one or more of the actions are performed simultaneously. In some embodiments, additional actions can be performed.

Figures 2A, 2B, 2C, 2D:
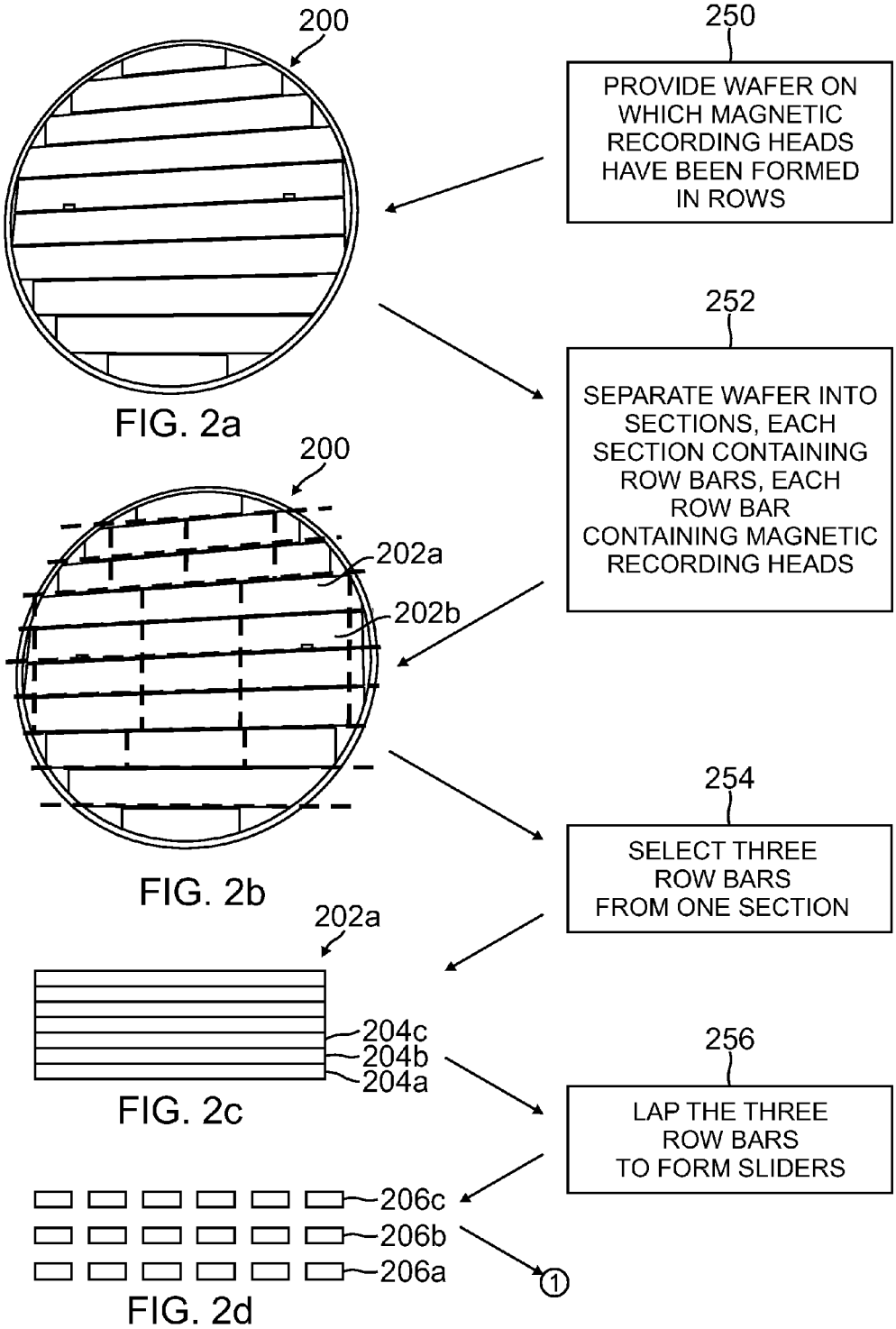
FIGS. 2*a* to 2*l* illustrate a sequence of views of a wafer, row bars, sliders, and corresponding MWW test data of the sliders in a process for correcting fabrication error in magnetic recording heads using magnetic write width (MWW) measurements in accordance with one embodiment of the invention.

FIGS. 2*a* to 2*l* illustrate a sequence of views of a wafer, row bars, sliders, and MWW test data of the sliders in a process for correcting fabrication error in magnetic recording heads using magnetic write width measurements (MWW) in accordance with one embodiment of the invention. In FIG. 2*a*, the process provides (250) a wafer 200 on which a number of magnetic recording heads/transducers (not visible) have been formed in rows. In FIG. 2*b*, the process separates (252) the wafer 200 into sections (202*a*, 202*b*), where each section contains a preselected number of row bars and each row bar contains one or more magnetic recording heads/transducers. In several embodiments, the wafer 200 may be separated into about 25 sections. In FIG. 2*c*, the process selects (254) three row bars (204*a*, 204*b*, 204*c*) from one section 202*a*. In several embodiments, the process can select more than three row bars for better accuracy. In FIG. 2*d*, the process laps (256) the three row bars to form sliders (206*a*, 206*b*, 206*c*).

Figures 2E, 2F, 2G:
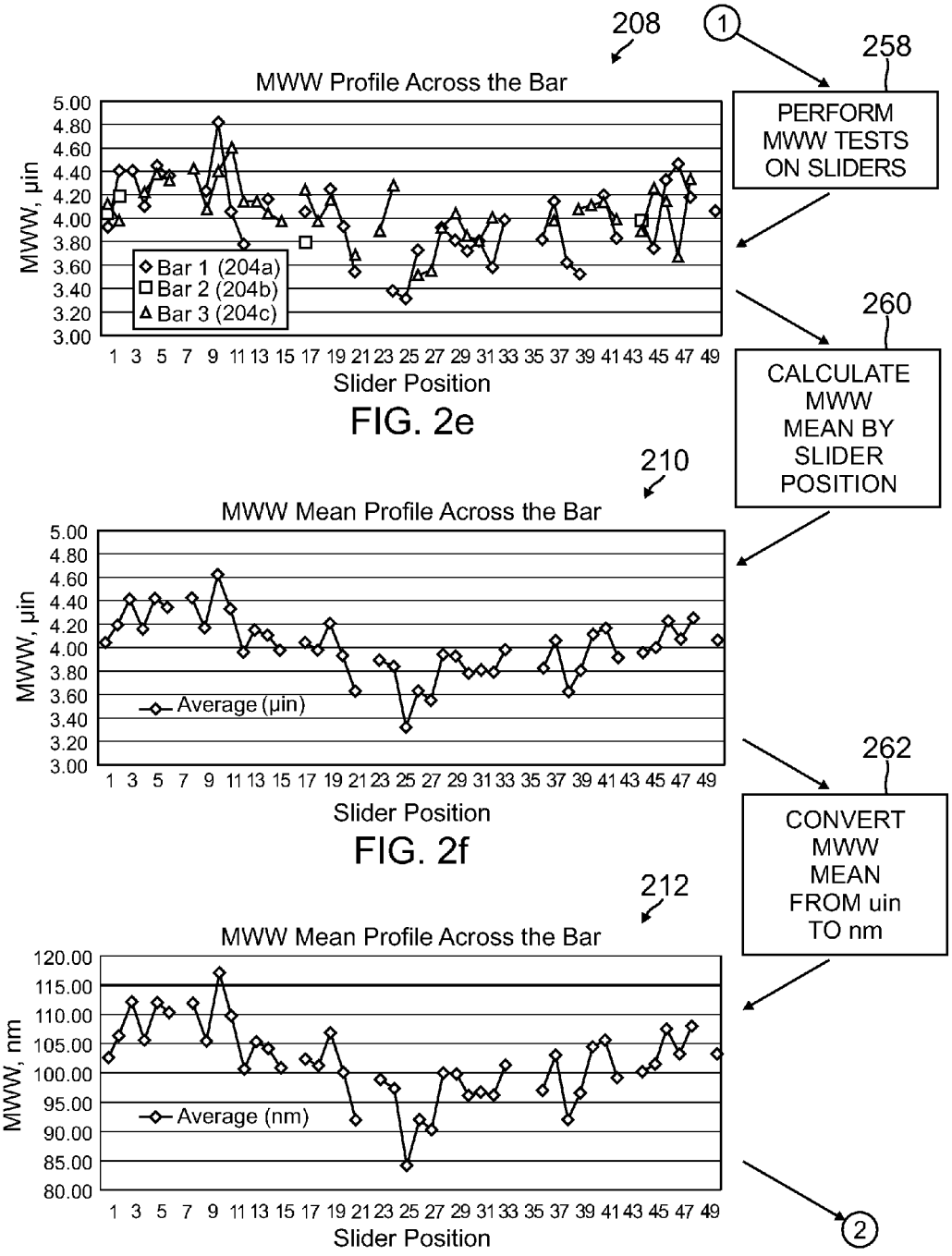

In FIG. 2*e*, the process performs (258) magnetic write width (MWW) tests on the sliders from the three selected row bars. In several embodiments, the MWW tests are performed on a test machine (e.g., spin-stand) configured to test the performance characteristics of one or more sliders. The MWW test results are illustrated in graph 208 of FIG. 2*e* showing the MWW profile (e.g., MWW measured in micro-inches or "uin") across each of the three row bars based on the slider position along the respective row bar. In FIG. 2*f*, the process calculates (260) a MWW mean profile across the three row bars by slider position. FIG. 2*f* illustrates a graph 210 of the MWW mean profile across (e.g., MWW mean in micro-inches or "uin") the three bars by slider position. In FIG. 2*g*, the process converts (262) the MWW mean from micro-inches or "uin" to nano-meters or "nm". FIG. 2*g* illustrates a graph 212 of the MWW mean profile across (e.g., MWW mean in nm) the three bars by slider position.

Figure 2H:
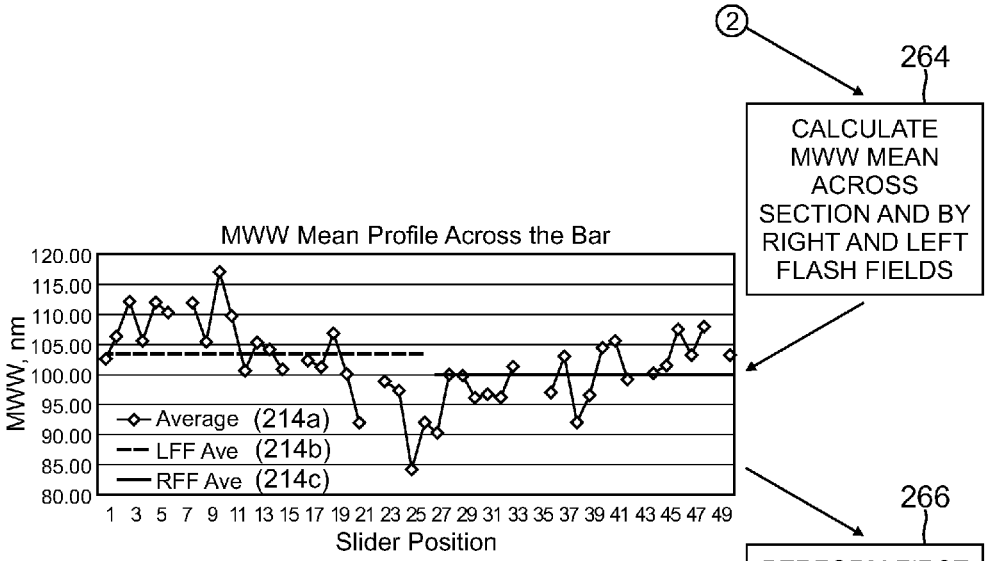

In FIG. 2*h*, the process calculates (264) the MWW mean across a right flash field (e.g., roughly half of the sliders of a given row bar) and a left flash field (e.g., roughly half of the sliders of a given row bar). In some embodiments, the row bars have about 54 sliders and the first half or left flash field corresponds to sliders 1 to 27 and the second half or right flash field corresponds to sliders 28 to 54. In one embodiment, such as the one depicted in FIG. 2*i*, the first slider and the last slider are not considered such that the left flash field includes sliders 2 to 27 and the right flash field includes sliders 28 to 53. In other embodiments, the row bars can be segmented into different groups for the flash fields in accordance with particular design goals. In several embodiments, each row bar may include about 50 to 60 sliders. FIG. 2*h* illustrates a graph of the MWW mean for the three row bars 214*a*, for the left flash field 214*b*, and for the right flash field 214*c*.

Figure 2I:
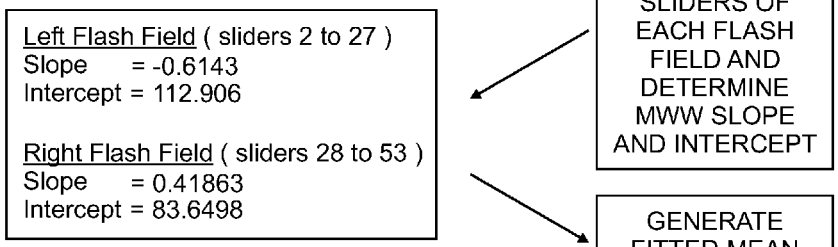
Figure 2J:
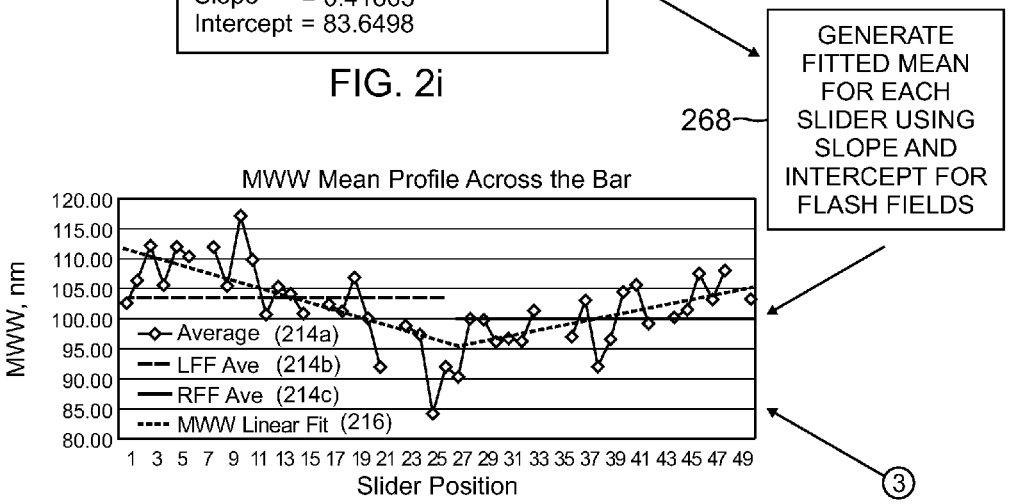

In FIG. 2*i*, the process performs (266) a first order line fit across the sliders of each flash field and determines a MWW slope and intercept for each flash field. FIG. 2*i* illustrates a table showing the MWW slope and intercept values for the right and left flash fields. In several embodiments, the process can perform a line fit that is greater than a first order line fit instead of the first order line fit. In FIG. 2*j*, the process generates (268) a fitted mean 216 for each slider using the slope and intercept values for the left and right flash fields. FIG. 2*j* illustrates a graph of the MWW values for the mean of the three row bars 214*a*, the mean of the left flash field 214*b*, the mean of the right flash field 214*c*, and the fitted mean 216.

Figures 2K, 2L:
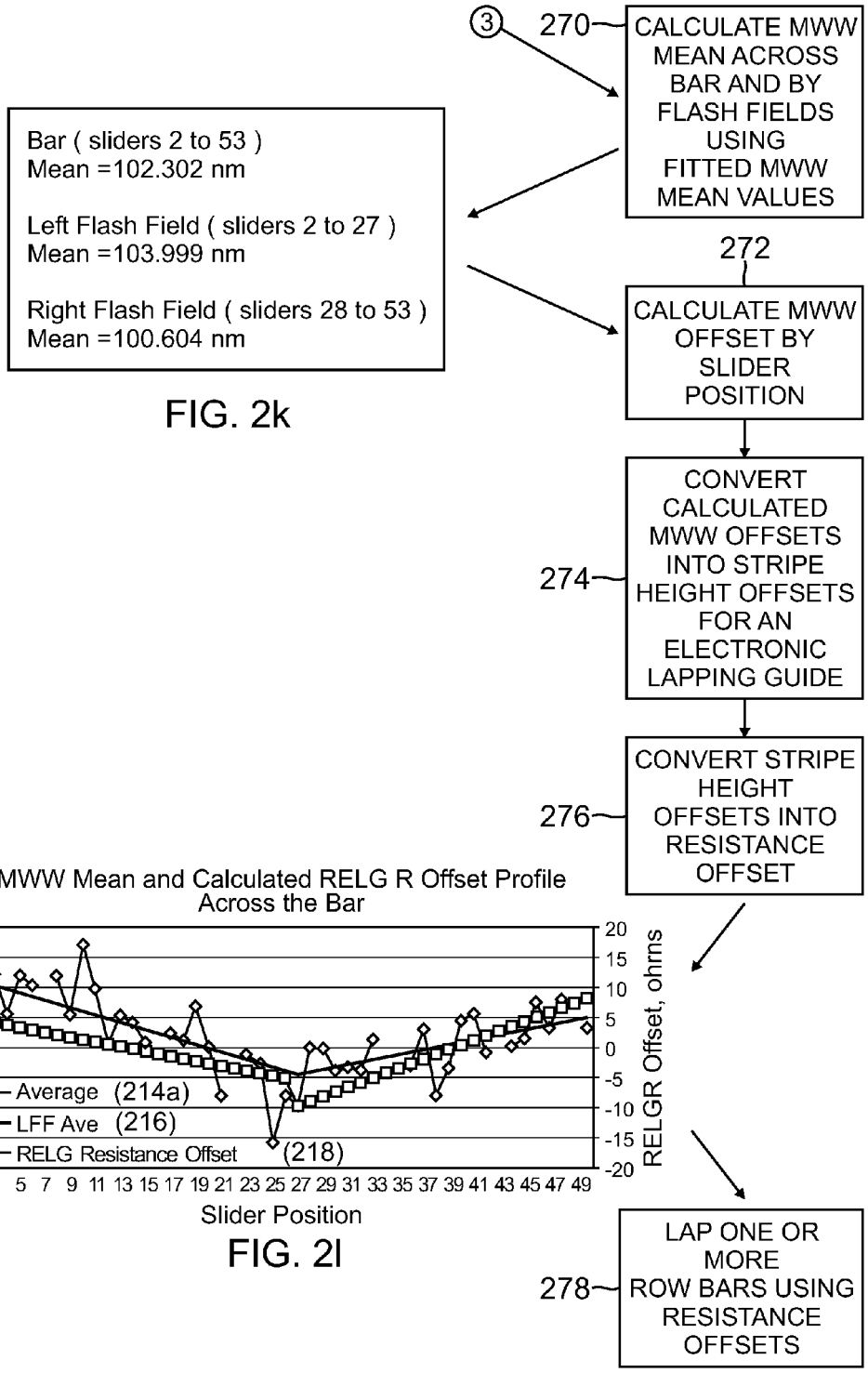

In FIG. 2*k*, the process calculates (270) a MWW mean across the bars and across the right and left flash fields using the fitted mean values. FIG. 2*k* illustrates a table showing the MWW mean values across the bars and across the right and left flash fields using the fitted mean values. The process then calculates (272) a MWW offset for each slider by the slider position. In one embodiment, the MWW offset is calculated using the expression, (slider MWW−flash field MWW mean)+(flash field MWW mean−section mean). The process then converts (274) the calculated MWW offsets into stripe height offsets for an electronic lapping guide (ELG). In several embodiments, the ELG is for a magnetic read head of the slider. In some embodiments, the ELG is for a magnetic write head of the slider. In one embodiment, the stripe height offsets are calculated using the expression, (slider MWW offset/(MWW to stripe height sensitivity)), where the MWW to stripe height sensitivity is a known parameter of the sliders from a particular wafer.

In FIG. 2*l*, the process converts (276) the stripe height offsets into resistance offsets 218. FIG. 2*l* is a graph illustrating the MWW mean 214*a*, the MWW fitted mean 216, and the resistance offsets 218 where each of these parameters is shown by slider position. In one embodiment, the resistance offsets are calculated using the expression, (wafer resistance*MC slope)/(reader stripe height−MC intercept), where the MC or model curve is a transfer function that converts the calculated "stripe height offset" into its equivalent resistance value. The process then laps (278) one or more row bars of the section of the wafer using the resistance offsets. In one embodiment, the process laps all remaining row bars of the section from which the initial three row bars originated.

In several embodiments, the process can be repeated for other sections on the wafer where each section has its own error profile based on the first row bars that are processed to form the sliders tested for MWW. In a number of embodiments, the process is repeated for each of the other sections on the wafer. In some embodiments, the process laps (278) the one or more row bars of the section using the resistance offsets and a preselected limit (e.g., upper or lower boundary) for the stripe height of the component.

In several embodiments, the process laps (256) the three row bars to form the sliders using a first lapping profile (e.g., initial lapping profile). In such case, the process then laps (278) the other row bars using a second lapping profile (e.g., updated lapping profile) that takes into account the second error profile (e.g., first lapping profile modified by stripe height offsets or MWW offsets derived from MWW tests).

In several embodiments, the process can be executed on any general purpose type computer having a processor, memory, and other such components that are well known in the art. In one embodiment, the process can perform the sequence of actions in a different order. In another embodiment, the process can skip one or more of the actions. In other embodiments, one or more of the actions are performed simultaneously. In some embodiments, additional actions can be performed.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. A method of correcting for fabrication error in magnetic recording heads, the method comprising:

separating a wafer into a plurality of sections, each section containing a plurality of row bars, each row bar comprising a plurality of magnetic recording heads;

selecting a first row bar from a plurality of row bars of a first section of the plurality of sections;

lapping the first row bar to form a plurality of sliders;

performing a test of a magnetic write width (MWW) on each of the plurality of sliders;

calculating a first error profile for the first row bar based on results of the magnetic write width tests;

generating a second error profile for a stripe height of a component of the plurality of sliders based on the first error profile, wherein the component is selected from the group consisting of a magnetic read head and a magnetic write head; and lapping a second row bar from the plurality of row bars of the first section using the second error profile.

2. The method of claim 1:

wherein the lapping the first row bar to form the plurality of sliders comprises lapping the first row bar in accordance with a first lapping profile to form the plurality of sliders; and wherein the lapping the second row bar from the plurality of row bars of the first section using the second error profile comprises lapping the second row bar using a second lapping profile derived from the second error profile and the first lapping profile.

3. The method of claim 1, the calculating the first error profile for the first row bar based on results of the magnetic write width tests comprises calculating the first error profile for the first row bar based on results of the magnetic write width tests and a position within the first row bar of a respective slider among the plurality of sliders.

4. The method of claim 1:

wherein the selecting the first row bar from the plurality of row bars of the first section of the plurality of sections comprises selecting at least three row bars from the plurality of row bars of the first section;

wherein the lapping the first row bar to form the plurality of sliders comprises lapping the at least three row bars to form the plurality of sliders; and wherein the calculating the first error profile for the first row bar based on results of the magnetic write width tests comprises calculating the first error profile for the at least three row bars based on results of the magnetic write width tests.

5. The method of claim 1, wherein the component is the magnetic read head.

6. The method of claim 1:

wherein the calculating the first error profile for the first row bar based on results of the magnetic write width tests comprises:

calculating a first mean error based on results of the magnetic write width tests for a first half of the plurality of sliders of the first row bar; and calculating a second mean error based on results of the magnetic write width tests for a second half of the plurality of sliders of the first row bar; and wherein the generating the second error profile for the stripe height of the component of the plurality of sliders based on the first error profile comprises generating the second error profile for the stripe height of the component of the plurality of sliders based on a first offset from the first mean error and a second offset from the second mean error.

7. The method of claim 6:

wherein the first row bar comprises 54 sliders;

wherein the first half corresponds to sliders 1 to 27 of the first row bar; and wherein the second half corresponds to sliders 28 to 54 of the first row bar.

8. The method of claim 1, wherein the calculating the first error profile for the first row bar based on results of the magnetic write width tests comprises:

calculating a mean of the results of the magnetic write width tests; and calculating an offset from the mean of the results for each of the plurality of sliders.

9. The method of claim 1, wherein the lapping the second row bar from the plurality of row bars of the first section using the second error profile comprises lapping the second row bar from the plurality of row bars of the first section using the second error profile and a preselected limit for the stripe height of the component.

10. The method of claim 1:

wherein the selecting the first row bar from the plurality of row bars of the first section of the plurality of sections comprises selecting at least three row bars from the plurality of row bars of the first section;

wherein the lapping the first row bar to form the plurality of sliders comprises lapping the at least three row bars to form the plurality of sliders; and wherein the calculating the first error profile for the first row bar based on results of the magnetic write width tests comprises:

calculating a mean of the results of the magnetic write width tests for the sliders of the at least three row bars; and calculating an offset from the mean of the results for each of the plurality of sliders.

11. The method of claim 10, further comprising calculating a resistance for the offsets from the mean for each of the plurality of sliders.

12. The method of claim 10, further comprising:

wherein each of the at least three row bars comprises a preselected number of sliders;

wherein a first half corresponds to one half of the preselected number of sliders for one of the at least three row bars, and a second half corresponds to the other half of the preselected number of sliders of the one of the at least three row bars;

wherein the calculating the mean of the results of the magnetic write width tests for the at least three row bars comprises:

calculating a first mean error based on results of the magnetic write width tests for the first half of the plurality of sliders for each of the at least three row bars; and calculating a second mean error based on results of the magnetic write width tests for the second half of the plurality of sliders for each of the at least three row bars.

13. The method of claim 12, further comprising:

performing a line fit for the first mean error for the first half;

performing a line fit for the second mean error for the second half; and generating a fitted mean for each of the plurality of sliders based on the line fits for the first mean error and the second mean error.

14. The method of claim 13, further comprising:

calculating a mean across the at least three row bars using the fitted mean;

calculating a mean across the first half of the at least three row bars using the line fit for the first mean error;

calculating a mean across the second half of the at least three row bars using the line fit for the second mean error; and calculating a second offset for each slider of the plurality of sliders based on a position and the mean across the first half and the mean across the second half.

15. The method of claim 14, wherein the generating the second error profile for the stripe height of the component of the plurality of sliders based on the first error profile comprises:

converting, for each of the plurality of sliders, the second offset into a stripe height offset for the component.

16. The method of claim 15, further comprising:

converting, for each of the plurality of sliders, the stripe height offset into a resistance offset;

wherein the lapping the second row bar from the plurality of row bars of the first section using the second error profile comprises lapping the second row bar from the plurality of row bars of the first section using the resistance offsets for each of the plurality of sliders.

17. The method of claim 13:

wherein the line fit for the first mean error is a first order line fit or a line fit having an order higher than a first order line fit; and wherein the line fit for the second mean error is a first order line fit or a line fit having an order higher than a first order line fit.

* * * * *